350-331 SR
PFR36 XR 4,189,912

United States Patent [19]
Washizuka et al.

[11] 4,189,912
[45] Feb. 26, 1980

[54] COMBINATION CALCULATOR AND TIMEPIECE

[75] Inventors: Isamu Washizuka, Kyoto; Junji Aoki, Kashiwara; Tadashi Tomino, Yamatokoriyama, all of Japan

[73] Assignee: Sharp Kabushiki Kaisha, Osaka, Japan

[21] Appl. No.: 801,002

[22] Filed: May 26, 1977

[30] Foreign Application Priority Data

May 31, 1976 [JP] Japan ..... 51-71852[U]

[51] Int. Cl.[2] ..... G04B 37/12
[52] U.S. Cl. ..... 58/152 R; 58/88 E
[58] Field of Search ..... 58/23 R, 152 R, 88 R, 58/88 E, 57

[56] References Cited

U.S. PATENT DOCUMENTS 3,293,846 12/1964 Pauli ..... 58/88 R

FOREIGN PATENT DOCUMENTS 585929 3/1977 Switzerland ..... 58/152 R
587471 4/1977 Switzerland ..... 58/152 R

*Primary Examiner*—Gene Z. Rubinson
*Assistant Examiner*—Leonard W. Pojunas, Jr.
*Attorney, Agent, or Firm*—Birch, Stewart, Kolasch & Birch

[57] ABSTRACT

Disclosed is a combination calculator and timepiece. The combination calculator and timepiece consists of a calculator unit and timepiece unit, said calculator unit operating arithmetic function in response to key input means provided on the calculator unit and said timepiece unit functioning for horological operation and chronometrical operation etc. A display unit is included within the calculator unit for indicating arithmetic computation and another display is included within the timepiece unit for indicating time information derived from the timepiece unit. The display of the calculator unit and the display of the timepiece unit are disposed on opposite faces of a common housing enclosing the calculator and timepiece.

9 Claims, 7 Drawing Figures

COMBINATION CALCULATOR AND TIMEPIECE

BACKGROUND OF THE INVENTION

The present invention relates to a combination calculator and timepiece and more particularly to a combination calculator and timepiece comprising a calculator unit functioning for arithmetic computation in response to a plurality of numeral keys and command keys, and a timepiece unit for providing time information of horological information and chronometrical information etc., said calculator unit and said timepiece unit being stacked to face outwardly of each other.

In recent years there have been developed a variety of a combination calculator and timepiece devices which function for arithmetic computation and developing time information. In such a combination calculator and timepiece of the prior art, only one display unit is provided for selectively indicating the arithmetic computation results and the time information, said display selection being performed by selection means. The display of time information is inhibited during the calculator operation in the combination calculator and timepiece and vice versa in these prior art devices.

OBJECTS AND SUMMARY OF THE INVENTION

Accordingly, it is an object of the present invention to provide an improved combination calculator and timepiece comprising a calculator unit and a timepiece unit.

Another object of the present invention is to provide an improved combination calculator and timepiece comprising a calculator unit and a timepiece unit being stacked to face outwardly of each other.

Still another object of the present invention is to provide an improved combination calculator and timepiece comprising a calculator unit and a timepiece unit being stacked, each of displays of the calculator unit and the timepiece unit being arranged to face opposite directions, whereby display of the horological information is continuously enabled even when the calculator unit is operated without increasing the size of the combination calculator and timepiece.

To achieve the above objects, pursuant to an embodiment of the present invention, a calculator unit and a timepiece unit are stacked to face outwardly of each other, wherein each of the displays for simultaneously indicating the arithmetic computation of the calculator unit and the time information of the timepiece unit is arranged to face opposite directions.

One power source is employed for both the calculator unit and the timepiece unit in the combination calculator and timepiece. The display for the timepiece unit is always enabled by the power source during operation and of the calculator unit. The displays for the calculator unit and timepiece unit are liquid crystal displays and, therefore, thin displays of low power dissipation are provided for indicating the arithmetic computation results and the time information in a parallel fashion.

BRIEF DESCRIPTION OF THE DRAWING

The present invention will become more fully understood from the detailed description given hereinbelow and accompanying drawings which are given by way of illustration only, and thus are not limitative of the present invention and wherein.

DESCRIPTION OF THE PREFERRED EMBODIMENTS

Figure 1:
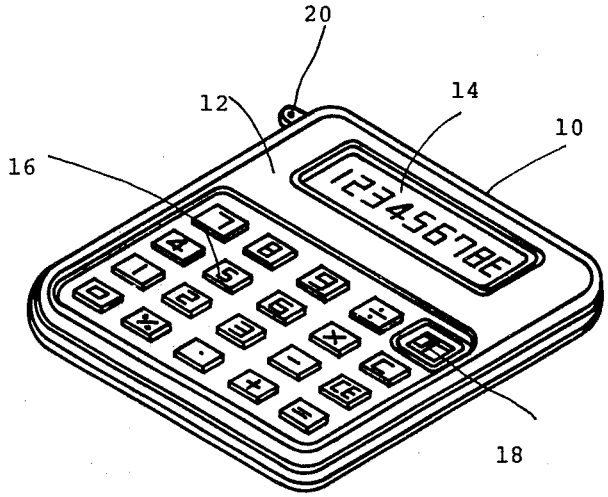
FIG. 1 is a perspective view of a combination calculator and timepiece of an embodiment of the present invention showing a calculator unit side of the combination calculator and timepiece.
Figure 2:
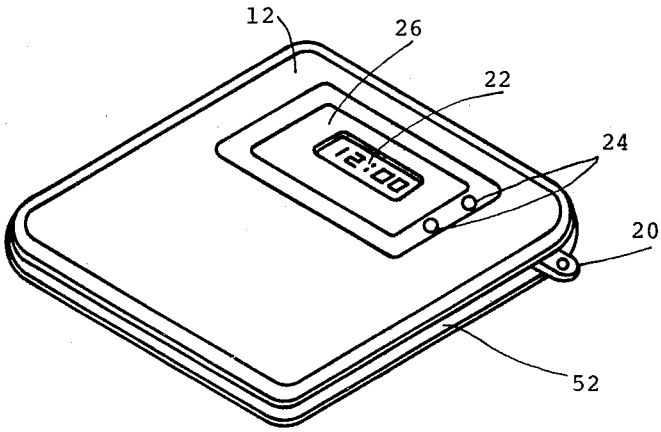
FIG. 2 is a perspective view of the combination calculator and timepiece of FIG. 1, wherein a timepiece unit side of the combination calculator and timepiece is shown.

FIGS. 1 and 2 show a combination calculator and timepiece 10 comprising a calculator unit and a timepiece unit, wherein two displays are provided for indicating arithmetic computation results of the calculator unit and time information of horological information, chronometrical information etc. of the timepiece unit.

The combination calculator and timepiece 10 comprises an aluminum calculator panel 12, a liquid crystal display 14, a keyboard 16 including numeral keys and function keys for introducing input data and an operation commands, and a power supply switch 18 in the calculator unit side as shown in FIG. 1. The liquid crystal display 14 is provided for the exclusive use of indicating the arithmetic computation of the calculator unit. The power supply switch 18 is employed for effecting power supply to the calculator unit. A ring means 20 is employed for receiving a carner strap for the combination calculator and timepiece 10. The combination calculator and timepiece 10 comprises the aluminum timepiece panel 52, a liquid crystal display 22, a correction switch 24, and a display window frame 26 of the liquid crystal display 22 in the timepiece unit side as shown in FIG. 2. The liquid crystal display 22 is provided for the exclusive use of indicating time, horological, or chronometrical information etc. of the timepiece unit. The correction switch 24 is employed for correcting the time information of, for example, hours, months, date, and second information stored in the timepiece unit.

Figure 3:
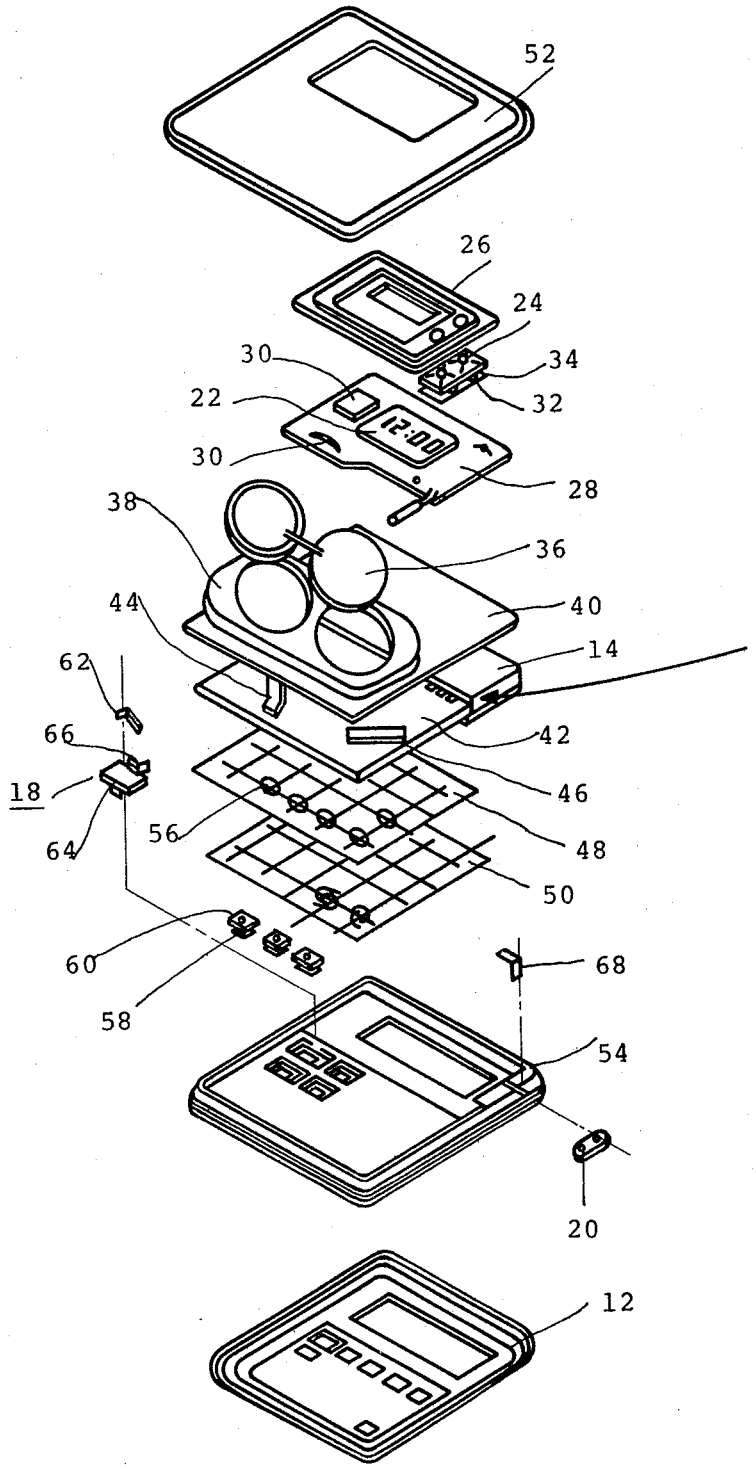
FIG. 3 is an exploded view of the combination calculator and timepiece of FIG. 1.

FIG. 3 shows an exploded view of a combination calculator and timepiece of the present invention. The timepiece unit of the combination calculator and timepiece of FIG. 3 comprises a plate board 28, a liquid crystal display 22, a circuit means 30, a correction switch 24, a display window frame 26, an isolation film 32, an electrically conductive rubber key 34, and an aluminum timepiece panel 52. The circuit means 30 is provided for maintaining the time, horological or chronometrical information etc., said circuit means 30 comprising a crystal oscillator, a divider, a counter, a decorder, a driver etc. (not shown) which functions as a base frequency signal generator and a time information keeping circuit. The correction switch 24 is connected to the electrically conductive rubber key 34 through the opening in the isolation film 32 to enable the correction operation. The top of the correction switch 24 is disposed under the surface of the aluminum timepiece panel 52 to prevent the correction switch 24 from being inadvertently operated.

A lithium battery 36 is included within a battery frame 38 disposed on an isolation film 40. The lithium battery 36 continuously supplies power to the timepiece unit, even when said lithium battery 36 supplies power to the calculator unit in response to enabling of the power supply switch 18. The isolation film 40 functions to separate the timepiece unit and the calculator unit from each other, except from the power source.

The calculator unit of the combination calculator and timepiece comprises a plate board 42, a liquid crystal display 14, battery terminals 44 and 46, an isolation spacer 48, spring means 50, a calculator cabinet 54, and aluminum calculator panel 12. The battery terminals 44 and 46 are disposed on the plate board 42 to transmit power energy from the lithium battery 36 to the calculator unit in response to operation of the power supply switch 18. The liquid crystal display 14 is disposed in contact with the plate board 42. The unit of the keyboard 16 comprises input key terminals (not shown) provided on the plate board 42, the isolation spacer 48 having a plurality of circular openings 56 in the opposite positions to the input key terminals, the spring means 50 for cooperation with a plurality of key tops 58 having electrically conductive rubber 60 of end portions thereof, the electrically conductive rubber 60 being contacted with the input key terminals in response to depression of the keytops 58. A fixed terminal 62 is disposed on the bottom surface side of the spring means 50 for the power supply switch 18. The reference numeral 64 represents a knob having a movable terminal 66 for contacting the fixed terminal 62 in the power supply switch 18. A shaft 68 is provided within the calculator cabinet 54 for engaging the ring means 20 which is provided for a carrying strap. The ring means 20 is rotatable around the shaft 68 to be enclosed within the calculator cabinet 54. The aluminum timepiece panel 52 is removable from the calculator cabinet 54 to replace the lithium battery 36, when necessary.

Figure 4:
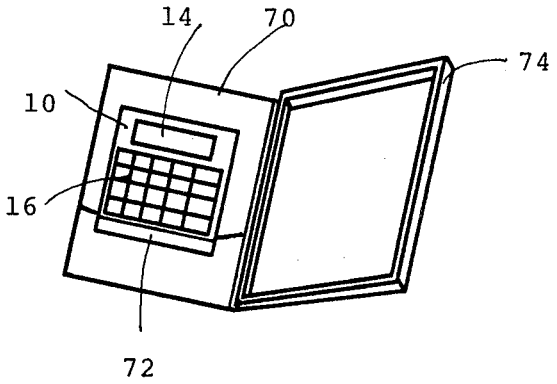
FIG. 4 is a perspective view of the combination calculator and timepiece of FIG. 1 included in a note-book shaped case.
Figure 5:
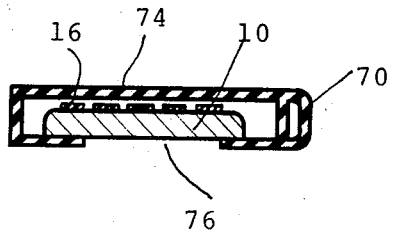
FIG. 5 is a cross-sectional view of the combination calculator and timepiece included in the note-book shaped case of FIG. 4.
Figure 6:
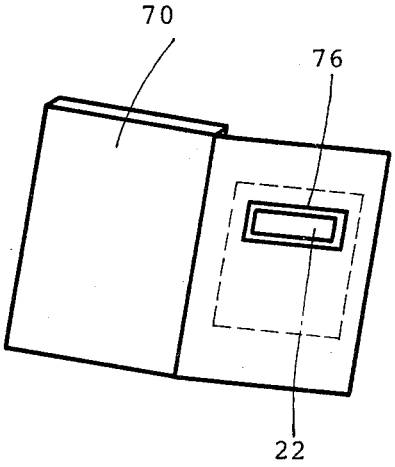
FIG. 6 is a rear view of the combination calculator and timepiece included in the note-book shaped case of FIG. 4.

FIGS. 4 through 6 show the combination calculator and timepiece 10 stored in a note-book shaped case 70. The note-book shaped case 70 comprises a pouch 72 for supporting the combination calculator and timepiece 10, a book shaped frame 74, and a window portion 76 for exposing the liquid crystal display 22 of the timepiece unit through the note-book shaped case 70.

The book shaped frame 74 is made of hard material to define the note-book shaped form, said frame 74 preventing the keyboard 16 from being damaged by the external force applied to the closed note-book shaped case 70.

Figure 7:
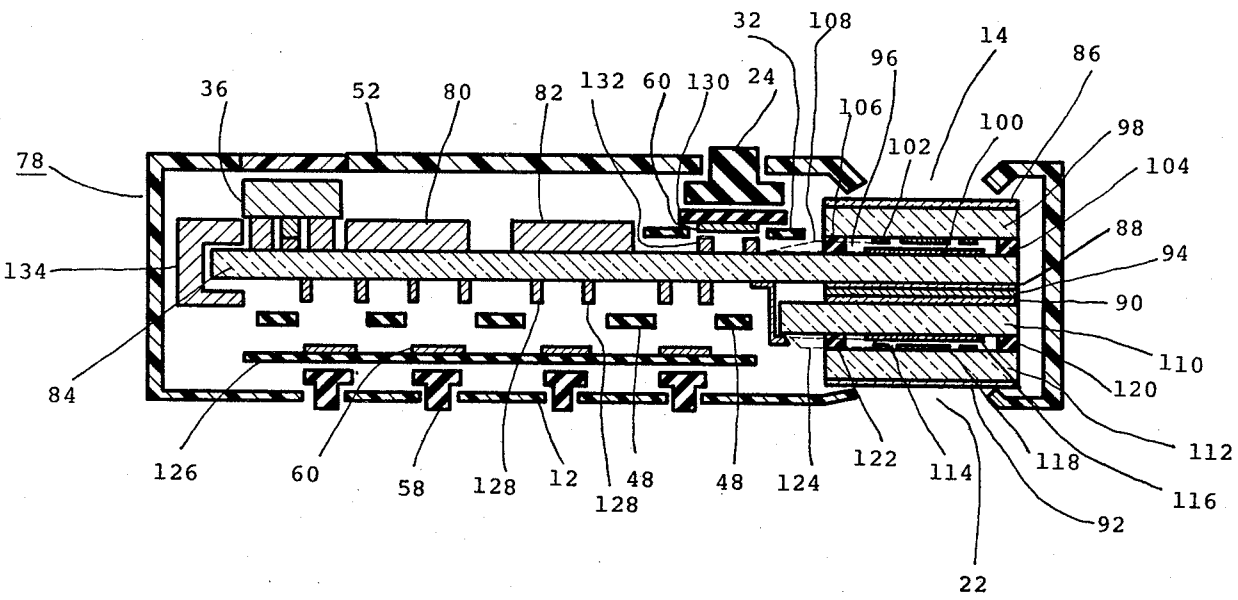
FIG. 7 is a longitudinal section view of a combination calculator and timepiece of another embodiment of the present invention.

FIG. 7 shows a combination calculator and timepiece 78 of another embodiment of the present invention in a longitudinal section view. Like elements corresponding to those of FIG. 3 are indicated by like numerals. The combination calculator and timepiece 78 comprises circuit means 80 for calculator function and circuit means 82 for timepiece operation on a single glass substrate 84, said glass plate 84 functioning as one substrate for the liquid crystal display 14 for the timepiece unit at the end portion thereof. The glass substrate 84 is utilized for arranging wiring means for the calculator unit and timepiece unit. The base frequency signal generator and the time information keeping circuit for the timepiece operation are included within the circuit means 82 and, moreover, the computation circuit for the calculator operation is included within the circuit means 80.

Since the liquid crystal displays 14 and 22 of FIG. 7 comprise liquid crystal material of the field effect mode type, polarizers 86 through 92 and reflector 94 having reflection surfaces on both sides are provided within the liquid crystal displays 14 and 22. The reflector 94 is made of aluminum. The liquid crystal display 14 of the timepiece unit comprises the glass substrate 84, liquid crystal material 96 filled between the glass substrate 84 and glass plate 98, a common electrode 100 formed on the glass substrate 84, segment electrodes 102 formed on the glass plate 98, spacer means 104 and 106 in the end portion of the glass plate 98, the polarizer 86 on the glass plate 98, the polarizer 88 on the glass substrate 84, and the reflector 94 on the polarizer 88. Wiring means 108 for the common electrode 100 and the segment electrodes 102 are disposed on the glass substrate 84.

On the other hand, the liquid crystal display 22 of the calculator unit comprises glass plates 110 and 112, liquid crystal material 114, a common electrode 116 formed on the glass plate 110, segment electrodes 118 formed on the glass plate 112, spacer means 120 and 122 secured in the end portion of the glass plate 112, the polarizer 90 mounted on the glass plate 110, the polarizer 92 mounted on the glass plate 112, and the reflector 94 mounted on the polarizer 90. The common electrode 116 and the segment electrodes 118 are connected to the circuit means 80 for the calculator unit via wiring means 124.

The keyboard 16 of the calculator unit is arranged on the glass substrate 84 on the other side of the circuit means 80 from the calculator unit. The keyboard 16 comprises the keytops 58, the electrically conductive rubber 60 secured on a flexible plate 126, the isolation spacer 48, and key terminals 128 formed on the substrate glass 84. A key input system comprises a set of key terminals 128, the electrically conductive rubber 60, and keytops 58, wherein the key terminals 128 are electrically connected to the electrically conductive rubber 60 formed on the flexible plate 126 when the keytop 58 is depressed.

The correction switch 24 of the timepiece unit is associated with the electrically conductive rubber 60 on a flexible plate 130, the isolation film 32, and key terminals 132. A connector 134 is provided at the side end of the glass substrate 84 for connecting the circuit means 80 of the calculator unit to the key input system. Although in the foregoing embodiment no power supply switch for the display of the timepiece unit is arranged on the timepiece unit, a power supply switch may be provided for selectively enabling the time information display.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A combination calculator and timepiece, comprising:

a housing means for defining and enclosing a cavity containing a variety of electrical components, said housing means having a first and a second major surface, the external side of said first major surface facing in a first direction, the external side of said second major surface facing in a second direction, said first direction being substantially opposed to and opposite from said second direction, said housing means further accommodating a means for introducing numerical information into said combination calculator and timepiece, said cavity of said housing means further containing a base frequency signal generator, a power supply, a power supply switch, a computation circuit means for calculator operation, a time information keeping circuit means for timepiece operation, a first digital display means for displaying information stored in said computation circuit means, and a second digital display means for displaying information stored in said time information keeping circuit means, said combination calculator and timepiece further comprising;

a common substrate means disposed within said cavity of said housing means for dividing said cavity of said housing means into a first compartment and a second compartment, said first digital display being supported by said common substrate and located within said first compartment, said first major surface of said housing means having a first window means disposed therethrough thereby defining a first hole in said first major surface for viewing a display within said housing means, said first digital display being visible from a position external to said housing means through said first window means disposed in said first major surface of said housing means, said means for introducing numerical information into said combination calculator and timepiece comprising a plurality of key switch means secured on said common substrate means and disposed within said first compartment for introducing information into said combination calculator and timepiece, said first major surface further including a plurality of openings disposed therethrough, said plurality of key switch means being visible from a position external to said housing means and protruding through said plurality of openings in said first major surface of said housing means, said second digital display being supported by said common substrate and disposed within said second compartment, said second major surface of said housing means having a second window means disposed therethrough thereby defining a second hole in said second major surface for viewing a display within said housing means, said second digital display being visible from a position external to said housing through said second window means disposed on said second major surface of said housing means; and a time correction switch means secured by said common substrate and disposed within said second compartment for introducing a time correction command into said combination calculator and timepiece, said second major surface further including at least one opening disposed therethrough, said time correction switch means being visible from a position external to said housing and protruding through said at least one opening in said second major surface of said housing means.

2. A combination calculator and timepiece in accordance with claim 1 wherein the computation circuit, the base frequency signal generator, and the time information keeping circuit are arranged on the same side of the common substrate means.

3. A combination calculator and timepiece in accordance with claim 1 wherein the common substrate means has an extended portion which functions as the substrate for the digital display.

4. A combination calculator and timepiece, comprising:

a housing means for defining and enclosing a cavity containing a variety of electrical components, said housing means having a first and a second major surface, the external side of said first major surface facing in a first direction, the external side of said second major surface facing in a second direction, said first direction being substantially opposed to and opposite from said second direction, said housing means further accommodating a means for introducing numerical information into said combination calculator and timepiece, said cavity of said housing means further containing a base frequency signal generator, a power supply, a power supply switch, a computation circuit means for calculator operation, a time information keeping circuit means for timepiece operation, a first digital display means for displaying information stored in said computation circuit means, and a second digital display means for displaying information stored in said time information keeping circuit means, said combination calculator and timepiece further comprising:

a common substrate means disposed within said cavity of said housing means for dividing said cavity of said housing means into a first compartment and a second compartment, said first digital display being supported by said common substrate and located within said first compartment, said first major surface of said housing means having a first window means disposed therethrough thereby defining a first hole in said first major surface for viewing a display within said housing means, said first digital display being visible from a position external to said housing means through said first window means disposed on said first major surface of said housing means, said means for introducing numerical information into said combination calculator and timepiece comprising a keyboard means including a contact means disposed on said common substrate, and an actuator means for rendering said contact means conductive and non-conductive, said actuator means being visible from a position external to said housing means, said second digital display being supported by said common substrate and disposed within said second compartment, said second major surface of said housing means having a second window means disposed therethrough thereby defining a second hole in said second major surface for viewing a display within said housing means, said second digital display being visible from a position external to said housing through said second window means disposed on said second major surface of said housing means; and a time correction switch means secured by said common substrate and disposed within said second compartment for introducing a time correction command into said combination calculator and timepiece, said time correction switch means being visible from a position external to said housing.

5. A combination calculator and timepiece in accordance with claim 4 wherein the computation circuit, the base frequency signal generator, and the time information keeping circuit are arranged on the same side of the common substrate means.

6. A combination calculator and timepiece in accordance with claim 4 wherein the common substrate means has an extended portion which functions as the substrate for the digital display.

7. A combination calculator and timepiece in accordance with claim 4 wherein said digital display means comprise liquid crystal displays, said liquid crystal displays including a liquid crystal material incorporated therein.

8. A combination calculator and timepiece in accordance with claim 4 wherein said power supply is utilized to power said timepiece and said calculator.

9. A combination calculator and timepiece in accordance with claim 4 wherein said housing means encloses said calculator and timepiece thereby protecting said timepiece and calculator from environmental conditions, the time information displayed by said timepiece being continuously displayed through one of said window means.

* * * * *